US006983903B2

(12) United States Patent
Chang

(10) Patent No.: US 6,983,903 B2
(45) Date of Patent: Jan. 10, 2006

(54) MULTI-FUNCTIONAL SHREDDER

(75) Inventor: James Shinil Chang, Arlington Heights, IL (US)

(73) Assignee: Fellowes, Inc., Itasca, IL (US)

( * ) Notice: Subject to any disclaimer, the term of this patent is extended or adjusted under 35 U.S.C. 154(b) by 119 days.

(21) Appl. No.: 10/347,700

(22) Filed: Jan. 22, 2003

(65) Prior Publication Data

US 2004/0140383 A1 Jul. 22, 2004

(51) Int. Cl.
*B02C 1/08* (2006.01)
*B02C 13/20* (2006.01)
*B02C 7/04* (2006.01)

(52) U.S. Cl. ..... 241/236; 241/291; 241/293; 241/295

(58) Field of Classification Search ..... 241/236, 241/291, 293, 295
See application file for complete search history.

(56) References Cited

U.S. PATENT DOCUMENTS

| | | | | |
|---|---|---|---|---|
| 4,690,340 | A | 9/1987 | Hatanaka | |
| 4,776,525 | A | 10/1988 | Hatanaka | |
| 4,844,366 | A | 7/1989 | Hatanaka | |
| 5,071,080 | A | 12/1991 | Herbst et al. | |
| 5,295,633 | A | 3/1994 | Kimbro et al. | |
| 5,511,732 | A | 4/1996 | Kroger et al. | |
| 5,636,801 | A | 6/1997 | Kroger | |
| 5,655,725 | A | 8/1997 | Kroger | |
| 5,676,321 | A | 10/1997 | Kroger | |
| 5,799,887 | A * | 9/1998 | Kroger | 241/236 |
| 5,826,809 | A | 10/1998 | Kroger | |
| 5,829,697 | A | 11/1998 | Kroger | |
| 5,954,280 | A | 9/1999 | Kroger et al. | |
| 5,961,058 | A | 10/1999 | Kroger | |
| 5,961,059 | A | 10/1999 | Kroger | |
| 6,260,780 | B1 | 7/2001 | Kroger et al. | |
| 2002/0100827 | A1 * | 8/2002 | Ho | 241/100 |
| 2003/0006330 | A1 | 1/2003 | Chang | |

* cited by examiner

*Primary Examiner*—Derris H. Banks
*Assistant Examiner*—Jason Y. Pahng
(74) *Attorney, Agent, or Firm*—Pillsbury Winthrop Shaw Pittman LLP

(57) ABSTRACT

The present application discloses a multi-functional shredder that is capable of effectively destroying both paper documents and rigid/semi-rigid objects, such as CDs or DVDs. This multifunctional shredder comprises a housing; a drive system including at least one motor; and at least two shafts rotatably mounted within the housing and coupled to the drive system to enable the drive system to counter-drive the shafts in respective opposing rotational cutting directions. Each of the shafts includes positive cutter elements and negative cutter elements, configured to cooperate to shred articles as the shafts are rotationally counter-driven by the drive system in the respective rotational cutting directions thereof. The positive cutting elements on each shaft have positive cutting parts angled in the respective rotational cutting directions of the shafts, and the negative cutting elements on each shaft have negative cutting parts angled opposite the respective rotational cutting directions of the shafts.

25 Claims, 8 Drawing Sheets

MULTI-FUNCTIONAL SHREDDER

FIELD OF THE INVENTION

The present invention relates to a multi-functional shredder, and in particular a shredder that has cutting elements suitable for cutting rigid or semi-rigid objects, such as CDs and DVDs, as well as paper.

BACKGROUND OF THE INVENTION

Shredders are well-known for use in shredding documents and other papers. Often, shredders are used for destroying outdated or extraneous documents, particularly those with confidential information. Typically, shredder designs have been directed specifically towards meeting the need for efficient, quiet, and effective shredding of paper, as that has been the traditional medium for storing information for many years.

With advances in information storage technology, many companies are storing information on computer mediums, and in particular recordable compact discs (CDs) and digital video discs (DVDs). CDs and DVDs allow a great deal of information to be stored in an extremely compact manner. Because CDs and DVDs are often used to store the same type of information as paper, it logically follows that businesses would still want to destroy CDs and DVDs containing confidential information. CDs and DVDs, however, are generally disc-shaped structures that are rigid, or at least semi-rigid, and the cutting elements typically used in shredders for cutting paper are not well-suited for effectively destroying such objects. Specifically, most shredders employ cutting elements having negative profiles because they have found to be the best for cutting paper. These negative profiles, however, tend to function poorly for cutting rigid/semi-rigid objects, such as CDs.

SUMMARY OF THE INVENTION

The present invention provides a multi-functional shredder that is capable of effectively destroying both paper documents and rigid/semi-rigid objects, such as CDs or DVDs. This multifunctional shredder comprises a housing; a drive system including at least one motor; and at least two shafts rotatably mounted within the housing and coupled to the drive system to enable the drive system to counter-drive the shafts in respective opposing rotational cutting directions. Each of the shafts includes positive cutter elements and negative cutter elements, configured to cooperate to shred articles as the shafts are rotationally counter-driven by the drive system in the respective rotational cutting directions thereof. The positive cutting elements on each shaft have positive cutting parts angled in the respective rotational cutting directions of the shafts, and the negative cutting elements on each shaft have negative cutting parts angled opposite the respective rotational cutting directions of the shafts.

Other objects, features, and advantages of the present invention will become apparent from the following detailed description, the accompanying drawings, and the appended claims.

DETAILED DESCRIPTION OF THE ILLUSTRATED EMBODIMENT OF THE INVENTION

Figure 1:
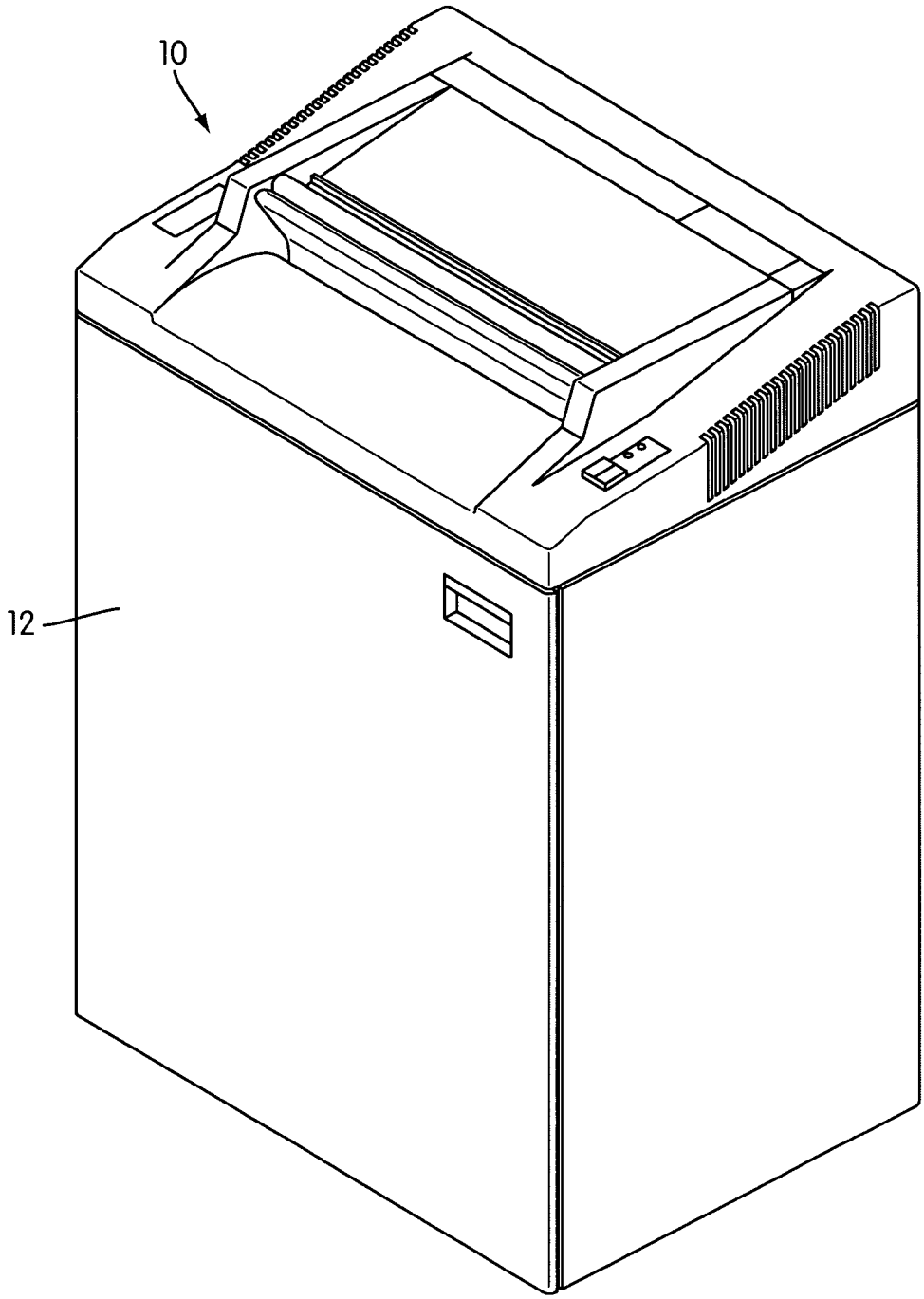
FIG. 1 is an exploded perspective view of a shredder.

FIG. 1 illustrates an example of a multi-functional shredder, generally indicated at 10, constructed in accordance with the present invention. The shredder 10 includes a housing 12, which may have any suitable configuration. The present invention is not limited to the one illustrated. By way of the example, the present invention may be incorporated into Model 480, 480CC and 480HS Powershred® shredders available from Fellowes, Inc., of Itasca, Ill., or any other type of shredder. Reference may be made to any one of the following U.S. patents for details concerning the general construction of a shredder: U.S. Pat. Nos. 5,071,080, 5,295,633, 5,511,732, 5,636,801, 6,260,780, 5,961,059, 5,655,725, 5,961,058, 5,954,280, 5,829,697, 5,826,809, 5,799,887, and 5,676,321, each of which is assigned to the assignee of the present application and hereby incorporated into the present application by reference. The shredder 10 also includes a drive system including at least one motor, which may be electrically powered. In the illustrated embodiment, only one motor is used. However, the drive system may have any number of motors, and may include one or more transmissions.

Figure 2:
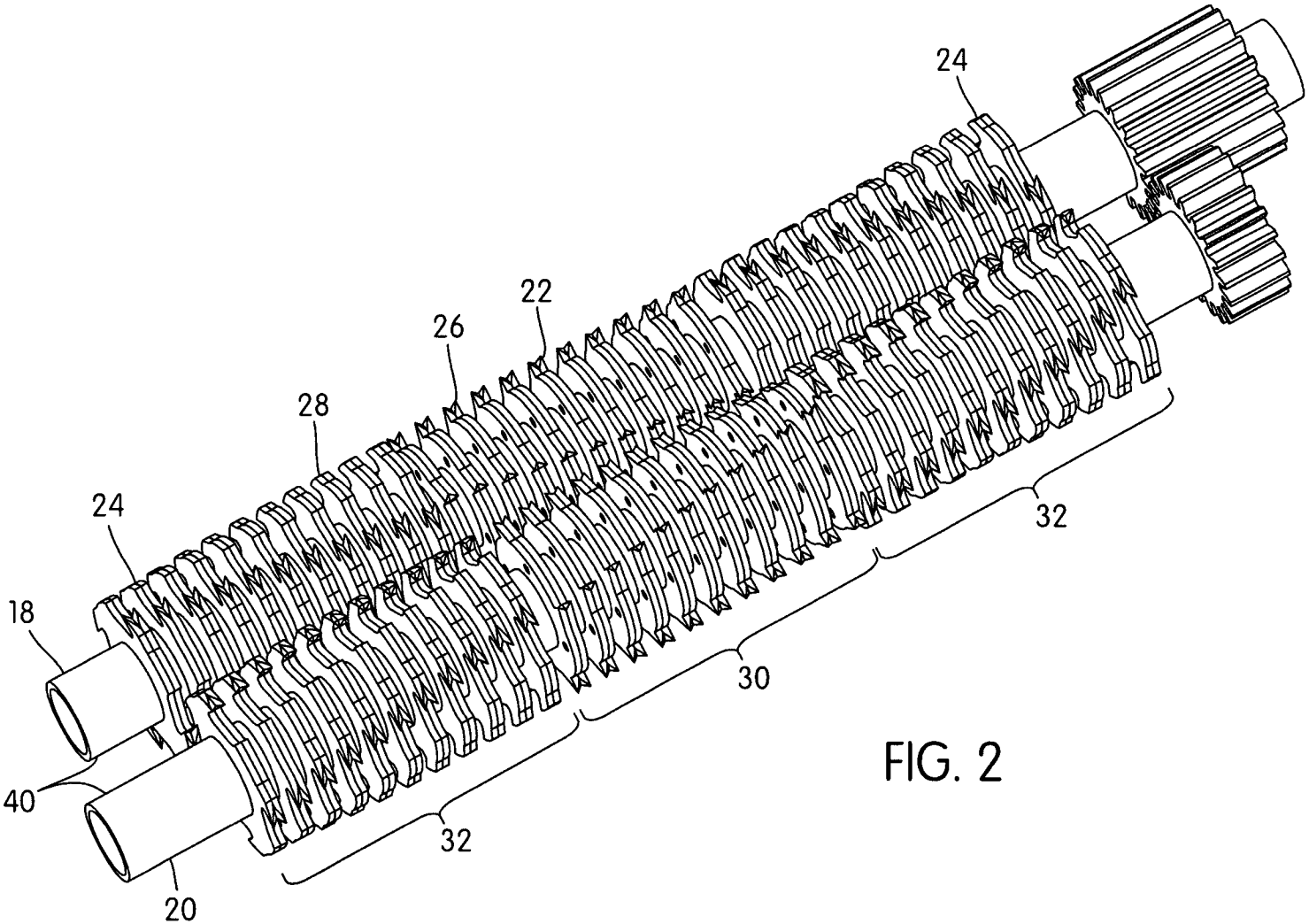
FIG. 2 is a perspective view of a pair of shafts used in the shredder of FIG. 1, with both positive and negative cutting elements arranged thereon, the shafts being isolated from the remainder of the shredder.

At least two shafts 18, 20 are rotatably mounted within the housing 12 and coupled to the drive system to enable the drive system to counter-drive the shafts in respective opposing rotational cutting directions. In FIG. 2, these counter-rotating directions would be the upper one rotating clockwise, and the lower one rotating counter-clockwise, thereby enabling cutter elements on the shafts 18, 20 to shred articles fed in the shafts 18, 20 and drive such articles down through the nip area defined between the shafts 18, 20. Each of the shafts 18, 20 includes positive cutter elements 22 and negative cutter elements 24. These cutter elements 22, 24 are configured to cooperate to shred articles as the shafts 18, 20 are rotationally counter-driven by the drive system in the respective rotational cutting directions thereof.

Figure 3:
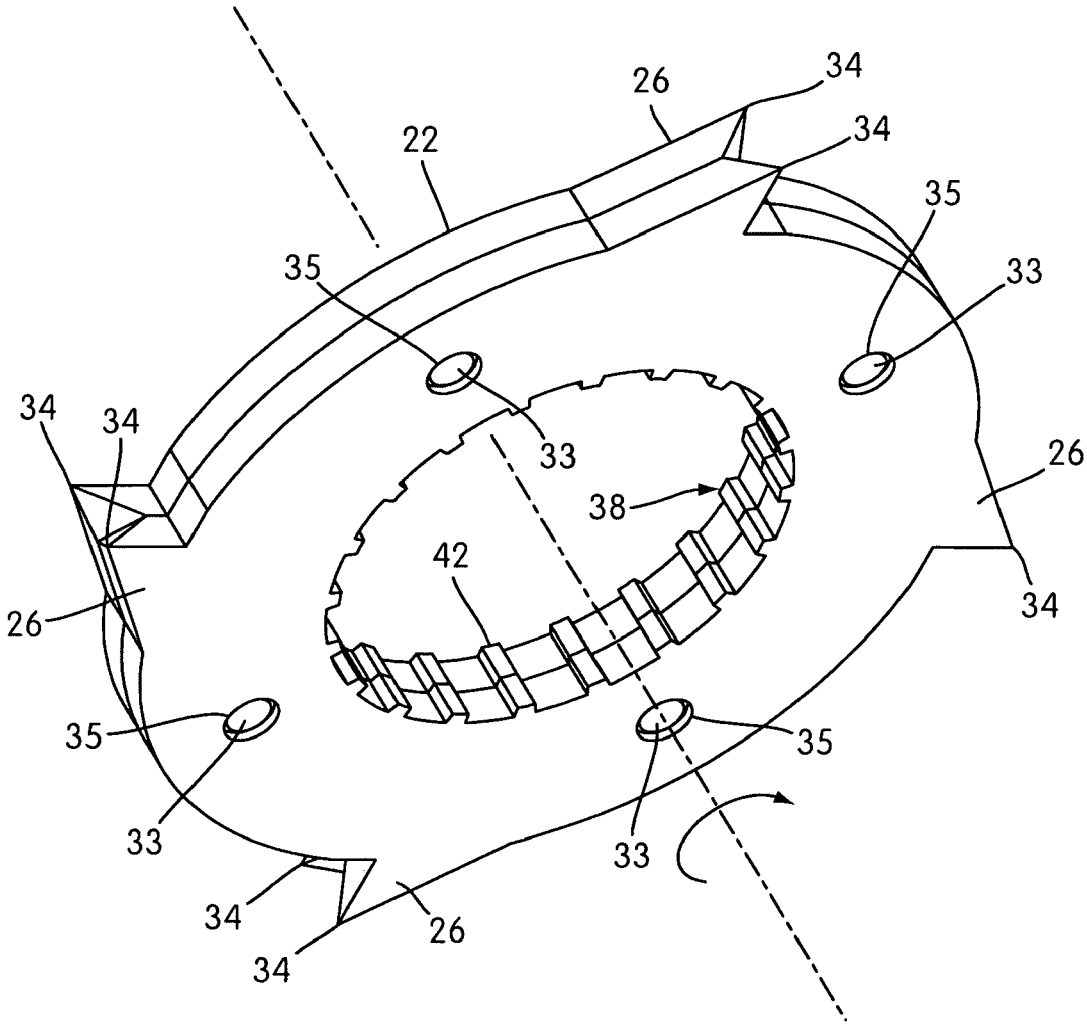
FIG. 3 is an isolated perspective view of a positive cutting element on the shafts in FIG. 2.
Figure 4:
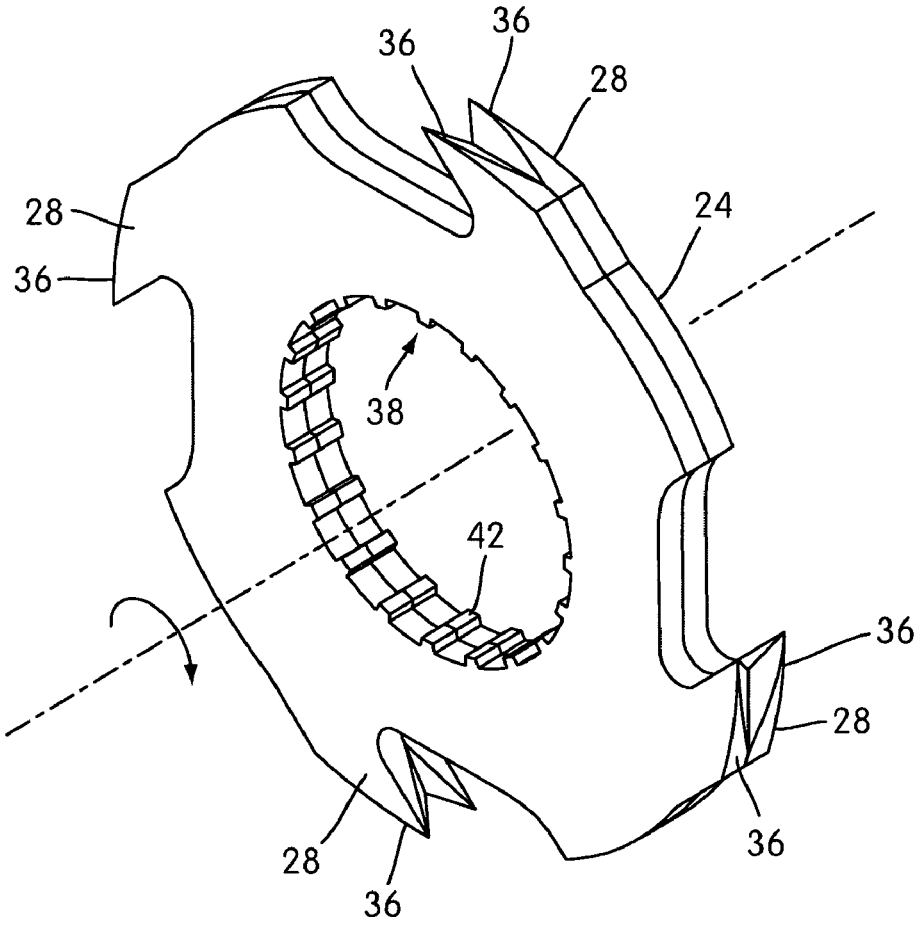
FIG. 4 is an isolated perspective view of a negative cutting element on the shafts in FIG. 2.

As best shown in FIG. 3, the positive cutting elements 22 on each shaft 18, 20 have positive cutting parts 26 angled in the respective rotational cutting directions of the shafts 18, 20. Likewise, as best shown in FIG. 4, the negative cutting elements 24 on each shaft 18, 20 have negative cutting parts 28 angled opposite the respective rotational cutting directions of the shafts 18, 20. As can be appreciated from the Figures, the positive cutting elements 22 have a body 23, and the negative cutting elements 24 also have a body 25. The positive cutting parts 26 extend radially from the body 23 and at their respective angles, and the negative cutting parts 28 extend radially from the body 25 and at their respective angles.

Preferably, but not necessarily, the positive cutting elements 22 on each shaft 18, 20 are arranged in at least one positive cutter element group 30 including a series of the positive cutting elements 22 arranged directly adjacent one another. Likewise, the negative cutting elements 24 on each shaft 18, 20 are arranged in at least one negative cutter element group 32 including a series of the negative cutting elements 24 arranged directly adjacent one another. The at least one positive element cutter group 30 and the at least one negative cutter element group 32 on one shaft 18 are arranged to cooperate with the at least one positive element cutter group 30 and the at least one negative cutter group 32, respectively, on the other shaft 20 to shred articles as the shafts 18, 20 are rotationally counter-driven by the drive system in the respective rotational cutting directions thereof. Each shaft 18, 20 may include at least three of these groups 30, 32 arranged in alternating relation between the positive and negative cutter element groups 30, 32. However, any number and any specific arrangement of groups may be used. In the illustrated embodiment, as best shown in FIG. 2, these groups includes one positive cutter element group 30 disposed generally centrally on each shaft 18, 20 and two negative cutter element groups 32 on opposing sides of the positive cutter element group 30. The cutter elements 22, 24 in these groups 30, 32 are arranged helically to ensure even cutting. The present invention, however, is not intended to be limited to the embodiment illustrated and is intended to encompass a wide range of variations. For example, the positive and negative elements 22,24 could be alternated along the shafts 18,20 and need not be grouped together.

As seen in FIG. 3, each positive cutting element 22 preferably has a plurality of the positive cutting parts 26, and as seen in FIG. 4, each negative cutting element 24 has a plurality of the negative cutting parts 28. Preferably, each positive cutting part 26 terminates in at least one sharp leading point 34 for piercing articles being shredded. That is, the point 34 leads the part 26 in the rotational cutting direction so as to lead the piercing action into the article being shredded. This is particularly useful for destroying rigid/semi-rigid articles, such as CDs and DVDs. Specifically, the piercing action helps to break up these types of articles into and through the interface of the counter-rotating elements. In the illustrated, exemplary embodiment of FIG. 3, each positive cutting part 26 terminates in a pair of such sharp points 34 for piercing articles being shredded. It is within the scope of the invention to use only one point per cutting part, or to use more than two points per cutting part, such as a three or four-pointed cutting part.

Figure 5:
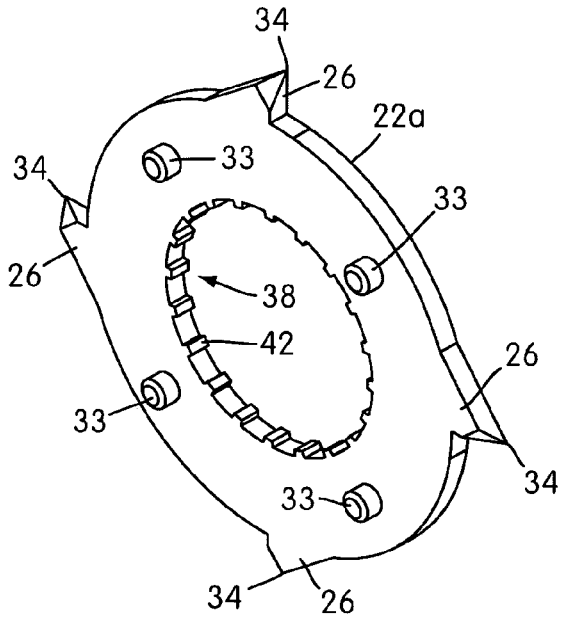
FIG. 5 is a perspective view of one half of an exemplary positive cutting element.
Figure 6:
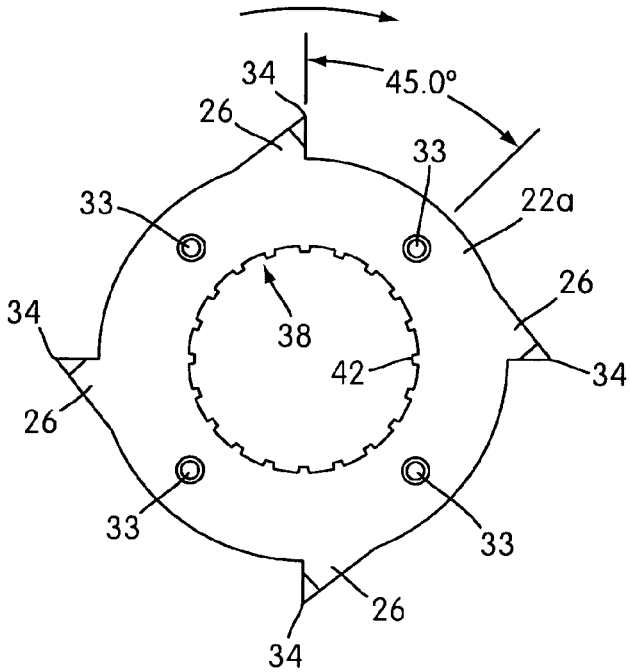
FIG. 6 is a profile view of the half cutter element of FIG. 5.
Figure 7:
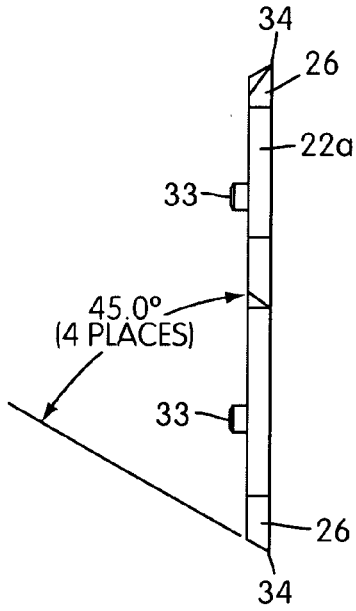
FIG. 7 is a radial view of the half cutter element of FIG. 5.
Figure 8:
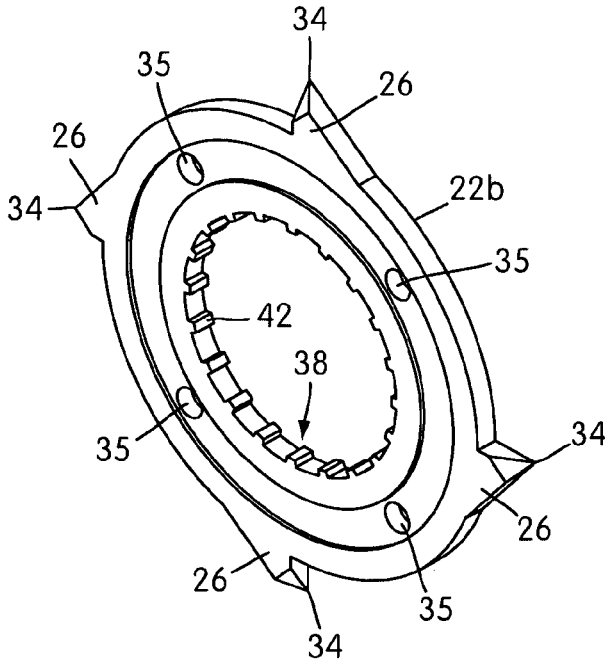
FIG. 8 is a perspective view of the other half of an exemplary cutting element, which couples to the half of FIG. 5.
Figure 9:
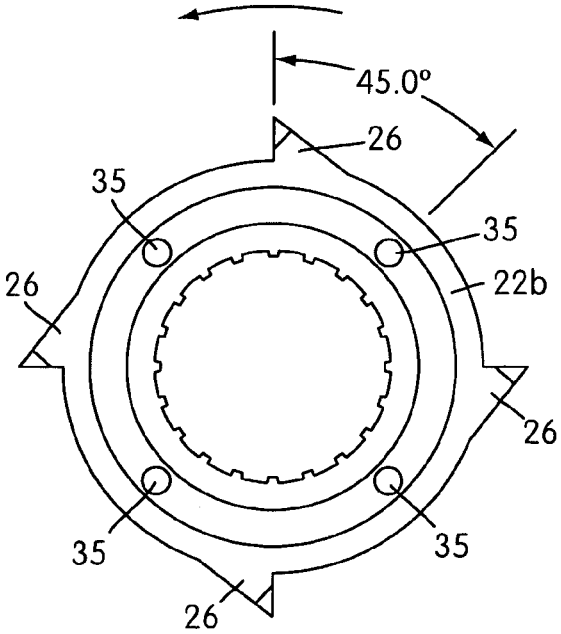
FIG. 9 is a profile view of the half cutter element of FIG. 8.
Figure 10:
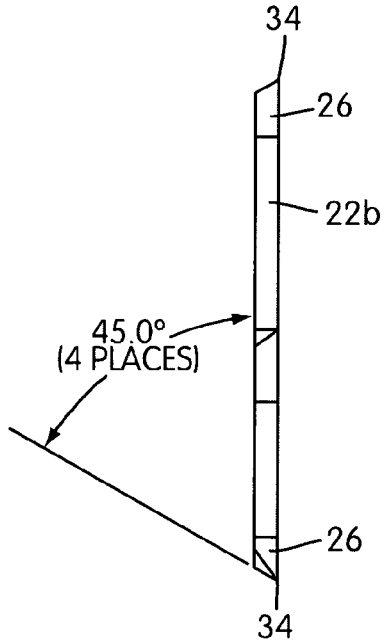
FIG. 10 is a radial view of the half cutter element of FIG. 8.

FIGS. 5–10 illustrate one exemplary positive cutter element 22. Specifically, FIGS. 5–7 illustrate one half 22*a* of the element 22 and FIGS. 8–10 illustrate the other half 22*b*. The halves are coupled by pins 33 on half 22*a* that are received in openings 35 in the other half 22*b* to rotationally lock them together. The halves 22*a* and 22*b* are otherwise mirror images and couple together to form the cutter element 22 illustrated in FIG. 3. The cutter element halves 22*a*, 22*b* are preferably formed by stamping or casting, but could also be formed by machining.

Figure 11:
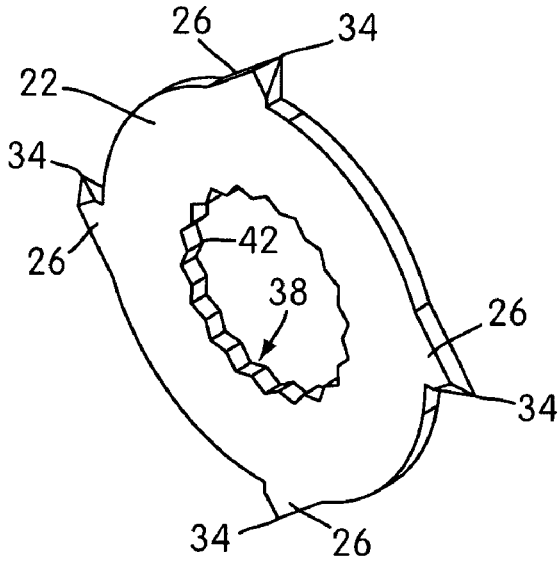
FIG. 11 is a perspective view of another exemplary positive cutter element.
Figure 12:
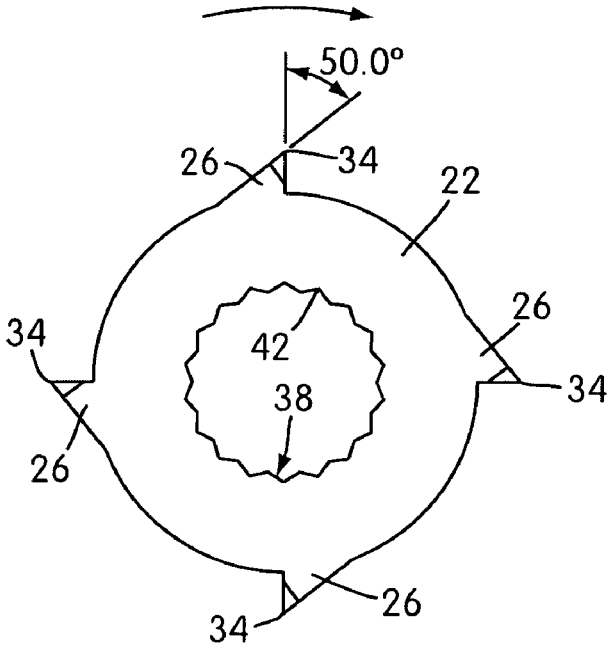
FIG. 12 is a profile view of the cutter element of FIG. 11.
Figure 13:
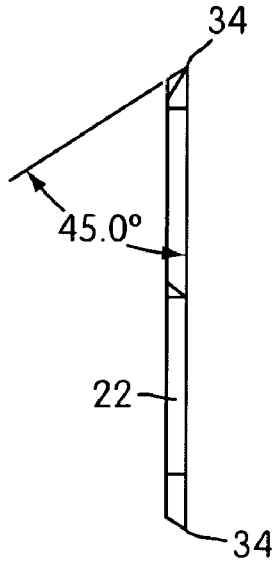
FIG. 13 is a radial view of the cutter element of FIG. 11.

FIGS. 11–13 illustrate another exemplary positive cutter element 22, but made from one piece of metal, preferably by stamping.

As best seen in FIG. 4, each negative cutting part 28 preferably includes at least one sharp cutting edge 36 angled opposite the respective rotational cutting directions of the shafts 18, 20 for slicing articles being shredded. As opposed to a positive cutting profile, this negative cutting profile is more efficient and effective for cutting flexible materials, such as paper. In the illustrated embodiment, each negative cutting part 28 includes two such sharp cutting edges 36 angled opposite the respective rotational cutting directions of the shafts 18, 20 for slicing articles being shredded. As with the positive cutter parts 26 of the positive cutter element 22, each negative cutter part 28 may have more or less than two cutting edges 36 (e.g. one, or three or more).

Figure 14:
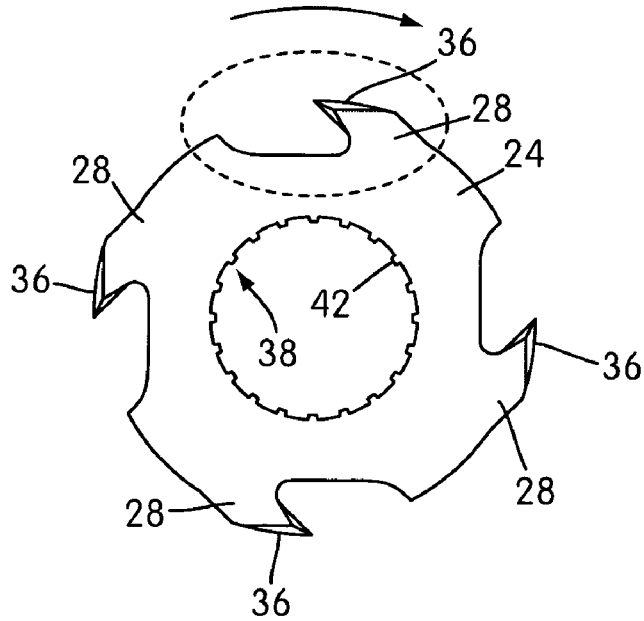
FIG. 14 is a profile view of an exemplary negative cutter element.
Figure 15:
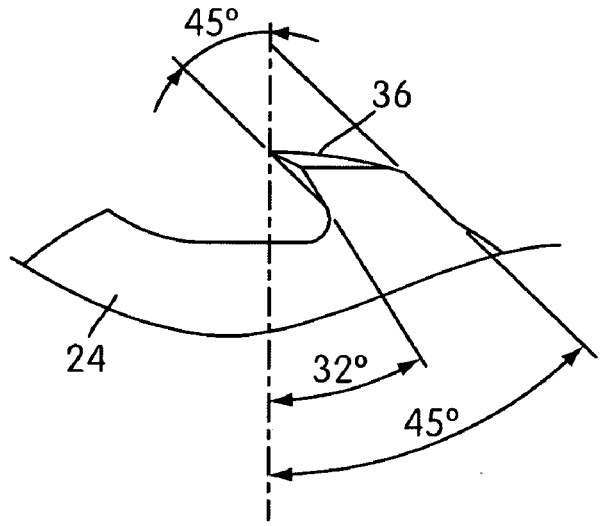
FIG. 15 is a detailed view of subject matter in FIG. 14.

FIGS. 14 and 15 show details of a profile for an exemplary negative cutter element 24. The profile shown may be applied to a one-piece element 24, which is what is depicted in FIGS. 14 and 15. Moreover, the structure in FIGS. 14 and 15 could also be one-half of a cutter element and be coupled to another mirror image half, as is the case with the positive cutter element as shown in FIGS. 5–10. The negative cutter element 24 could be formed by stamping or casting, or also by machining.

It should be understood the cutter element profiles illustrated herein are intended only to be examples and in no way limit the breadth of the invention.

Any suitable construction may be used to affix the cutter elements 22, 24 to the cutter shafts 18, 20, or the cutter elements 22, 24 may be integrally formed on the shafts 22, 24. As an exemplary way of attaching cutter elements 22, 24 to the shafts 18, 20, each cutter element 22, 24 may be provided with an interlocking structure 38 thereon. Each shaft 18, 20 may be a hollow shaft defined by a substantially tubular wall 40 and the tubular walls 40 of the shafts 18, 20 may be diametrically expanded to securely engage the tubular walls 40 with the interlocking structures 38 on the cutter elements 22, 24 to thereby secure the cutter elements 22, 24 on the shafts 18, 20. The tubular walls 40 of the shafts 18, 20 may be diametrically expanded to form protruding portions (not shown) on opposing sides of each cutter element 22, 24 to thereby secure the cutter elements 22, 24 against axial movement on the shafts 18, 20. Further, the interlocking structure 38 of each cutter element 22, 24 may be a series of teeth 42 on an internal opening of each cutter element 22, 24 sized to receive the shafts 18, 20 therein. Further details of this exemplary way of attaching the cutter elements are discussed in U.S. Pat. No. 5,799,887, the entirety of which is incorporated into the present application.

Alternatively, the shafts 18, 20 could have polygonal cross-sections (such as a regular hexagon) and the cutter elements 22, 24 could have matching polygonal internal openings for receiving the shafts. This would rotationally lock the cutter elements 22, 24 on the shafts 18, 20.

The foregoing detailed description has been provided solely to illustrate the functional and structural principles of the present invention, and is not intended to be limiting. To the contrary, the present invention is intended to encompass all variations, modifications, substitutions, and alterations within the spirit and scope of the appended claims.

What is claimed:

1. A multifunctional shredder, comprising:

a housing;

a drive system including at least one motor;

at least two shafts rotatably mounted within the housing and coupled to the drive system to enable the drive system to counter-drive the shafts in respective opposing rotational cutting directions;

each of the shafts including positive cutter elements and negative cutter elements configured to cooperate to shred articles as the shafts are rotationally counter-driven by the drive system in the respective rotational cutting directions thereof;

wherein the positive cutter elements on each shaft each have a positive cutter element body and positive cutting parts extending radially from the positive cutter element body and angled in the respective rotational cutting directions of the shafts, and wherein the negative cutter elements on each shaft each have a negative cutter element body and negative cutting parts extending radially from the negative cutter element body and angled opposite the respective rotational cutting directions of the shafts.

2. A shredder according to claim 1, wherein the positive cutter elements on each shaft are arranged in at least one positive cutter element group including a series of the positive cutter elements arranged directly adjacent one another and wherein the negative cutter elements on each shaft are arranged in at least one negative cutter element group including a series of the negative cutter elements arranged directly adjacent one another, the at least one positive element cutter group and the at least negative cutter element group on one shaft being arranged to cooperate with the at least one positive element cutter group and the at least one negative cutter group, respectively, on the other shaft to shred articles as the shafts are rotationally counter-driven by the drive system in the respective rotational cutting directions thereof.

3. A shredder according to claim 2, wherein each shaft includes at least three of said groups arranged in alternating relation between the positive and negative cutter element groups.

4. A shredder according to claim 3, wherein on each shaft the at least three groups includes one positive cutter element group disposed generally centrally on each shaft and two negative cutter element groups on opposing sides of the positive cutter element group.

5. A shredder according to claim 1, wherein each cutter element has an interlocking structure thereon and wherein each shaft is a hollow shaft defined by a substantially tubular wall, the tubular walls of the shafts being diametrically expanded to securely engage the tubular walls with the interlocking structures on the cutter elements to thereby secure the cutter elements on the shafts.

6. A shredder according to claim 5, wherein the tubular walls of the shafts are diametrically expanded to form protruding portions on opposing sides of each cutter element to thereby secure the cutter elements against axial movement on the shafts.

7. A shredder according to claim 6, wherein the interlocking structure of each cutter element is a series of teeth on an internal opening of each cutter element sized to receive the shaft therein.

8. A shredder according to claim 1, wherein each positive cutter element has a plurality of the positive cutting parts and wherein each negative cutter element has a plurality of the negative cutting parts.

9. A shredder according to claim 8, wherein each positive cutting part terminates in at least one leading point for piercing articles being shredded.

10. A shredder according to claim 9, wherein each positive cutting part terminates in a pair of leading points for piercing articles being shredded.

11. A shredder according to claim 8, wherein each negative cutting part includes at least one cutting edge angled opposite the respective rotational cutting directions of the shafts for slicing articles being shredded.

12. A shredder according to claim 11, wherein each negative cutting part includes two cutting edges angled opposite the respective rotational cutting directions of the shafts for slicing articles being shredded.

13. A shredder according to claim 1, wherein the positive cutter elements have only said positive cutting parts.

14. A shredder according to claim 1, wherein the negative cutter elements have only said negative cutting parts.

15. A multifunctional shredder, comprising:

a housing;

a drive system including at least one motor;

at least two shafts rotatably mounted within the housing and coupled to the drive system to enable the drive system to counter-drive the shafts in respective opposing rotational cutting directions;

each of the shafts including positive cutter elements and negative cutter elements configured to cooperate to shred articles as the shafts are rotationally counter-driven by the drive system in the respective rotational cutting directions thereof;

the positive cutter elements on each shaft having positive cutting parts angled in the respective rotational cutting directions of the shafts, and the negative cutter elements on each shaft having negative cutting parts angled opposite the respective rotational cutting directions of the shafts;

wherein the positive cutter elements on each shaft are arranged in at least one positive cutter element group including a series of the positive cutter elements arranged directly adjacent one another and wherein the negative cutter elements on each shaft are arranged in at least one negative cutter element group including a series of the negative cutter elements arranged directly adjacent one another, the at least one positive element cutter group and the at least negative cutter element group on one shaft being arranged to cooperate with the at least one positive element cutter group and the at least one negative cutter group, respectively, on the other shaft to shred articles as the shafts are rotationally counter-driven by the drive system in the respective rotational cutting directions thereof.

16. A shredder according to claim 15, wherein each shaft includes at least three of said groups arranged in alternating relation between the positive and negative cutter element groups.

17. A shredder according to claim 16, wherein on each shaft the at least three groups includes one positive cutter element group disposed generally centrally on each shaft and two negative cutter element groups on opposing sides of the positive cutter element group.

18. A shredder according to claim 15, wherein each cutter element has an interlocking structure thereon and wherein each shaft is a hollow shaft defined by a substantially tubular wall, the tubular walls of the shafts being diametrically expanded to securely engage the tubular walls with the interlocking structures on the cutter elements to thereby secure the cutter elements on the shafts.

19. A shredder according to claim 18, wherein the tubular walls of the shafts are diametrically expanded to form protruding portions on opposing sides of each cutter element to thereby secure the cutter elements against axial movement on the shafts.

20. A shredder according to claim 19, wherein the interlocking structure of each cutter element is a series of teeth on an internal opening of each cutter element sized to receive the shaft therein.

21. A shredder according to claim 15, wherein each positive cutter element has a plurality of the positive cutting parts and wherein each negative cutter element has a plurality of the negative cutting parts.

22. A shredder according to claim 21, wherein each positive cutting part terminates in at least one leading point for piercing articles being shredded.

23. A shredder according to claim 22, wherein each positive cutting part terminates in a pair of leading points for piercing articles being shredded.

24. A shredder according to claim 21, wherein each negative cutting part includes at least one cutting edge angled opposite the respective rotational cutting directions of the shafts for slicing articles being shredded.

25. A shredder according to claim 24, wherein each negative cutting part includes two cutting edges angled opposite the respective rotational cutting directions of the shafts for slicing articles being shredded.

* * * * *